US009810411B2

(12) United States Patent
Galli et al.

(10) Patent No.: US 9,810,411 B2
(45) **Date of Patent: *Nov. 7, 2017**

(54) PISTOL MOUNTED LIGHT AND OPERATION THEREOF

(71) Applicant: Emissive Energy Corp., North Kingstown, RI (US)

(72) Inventors: Robert D. Galli, North Kingstown, RI (US); Christopher J. O'Brien, Wakefield, RI (US)

(73) Assignee: EMISSIVE ENERGY CORP., North Kingstown, RI (US)

( * ) Notice: Subject to any disclaimer, the term of this patent is extended or adjusted under 35 U.S.C. 154(b) by 1 day.

This patent is subject to a terminal disclaimer.

(21) Appl. No.: 15/242,917

(22) Filed: Aug. 22, 2016

(65) Prior Publication Data

US 2016/0356468 A1 Dec. 8, 2016

Related U.S. Application Data

(63) Continuation of application No. 14/599,474, filed on Jan. 17, 2015, now Pat. No. 9,435,522, which is a (Continued)

(51) Int. Cl.

| | |
|---|---|
| ***F21V 23/04*** | (2006.01) |
| ***F21V 23/00*** | (2015.01) |
| ***F41G 1/36*** | (2006.01) |
| ***F21V 21/088*** | (2006.01) |
| ***F41G 1/35*** | (2006.01) |
| ***F41G 11/00*** | (2006.01) |
| ***F21L 4/00*** | (2006.01) |

(Continued)

(52) U.S. Cl.

CPC ..... *F21V 23/0414* (2013.01); *F21L 4/005* (2013.01); *F21V 21/0885* (2013.01); *F21V 23/003* (2013.01); *F21V 29/70* (2015.01); *F21V 33/008* (2013.01); *F41G 1/35* (2013.01); *F41G 1/36* (2013.01); *F41G 11/003* (2013.01); *F21V 23/0421* (2013.01); *F21W 2131/40* (2013.01); *F21Y 2115/10* (2016.08); *F41G 1/34* (2013.01)

(58) Field of Classification Search

CPC ..... F41C 27/00; F41C 33/0254; F41G 1/35; F41G 1/36; F41G 11/003; F21S 9/02; F21V 23/0414; F21V 23/0421

USPC ..... 362/110, 206

See application file for complete search history.

(56) References Cited

U.S. PATENT DOCUMENTS 5,581,898 A 12/1996 Thummel
5,584,137 A 12/1996 Teetzel (Continued)

OTHER PUBLICATIONS

Crimson Trace tacticle light model CMR-202 RailMaster, Nov. 11, 2012, WaybackMachine, http://www.crimsontrace.com/01-3470.*

(Continued)

*Primary Examiner* — Jong-Suk (James) Lee
*Assistant Examiner* — Colin Cattanach
(74) *Attorney, Agent, or Firm* — Barlow, Josephs & Holmes, Ltd.

(57) ABSTRACT

A flashlight for use with a pistol, the pistol having a trigger guard and a mounting rail. The flashlight includes an elongated housing having a clamping mechanism for mounting to the mounting rail, a light source at one end thereof, and paddle switches at an opposing end.

9 Claims, 13 Drawing Sheets

Related U.S. Application Data continuation-in-part of application No. 14/401,401, filed as application No. PCT/US2013/041644 on May 17, 2013.

(60) Provisional application No. 61/648,134, filed on May 17, 2012.

(51) Int. Cl.

| | |
|---|---|
| ***F21V 29/70*** | (2015.01) |
| ***F21V 33/00*** | (2006.01) |
| *F41G 1/34* | (2006.01) |
| *F21Y 115/10* | (2016.01) |
| *F21W 131/40* | (2006.01) |

(56) References Cited

U.S. PATENT DOCUMENTS

| | | | | |
|---|---|---|---|---|
| 5,758,448 | A | 6/1998 | Thummel | |
| 6,185,854 | B1 | 2/2001 | Solinsky et al. | |
| 6,571,503 | B2 | 6/2003 | Thorpe | |
| 7,260,912 | B2 | 8/2007 | Liu | |
| 7,305,790 | B2 | 12/2007 | Kay | |
| 7,735,255 | B1 | 6/2010 | Kincaid et al. | |
| 8,028,461 | B2 * | 10/2011 | NuDyke | F41C 27/00 42/117 |
| 8,510,979 | B1 | 8/2013 | Mortimer | |
| 9,435,522 | B2 * | 9/2016 | Galli | F21V 23/0414 |
| 2006/0104064 | A1 | 5/2006 | Sharrah et al. | |
| 2007/0039226 | A1 | 2/2007 | Stokes | |
| 2007/0193103 | A1 * | 8/2007 | Cheng | F41G 11/003 42/111 |
| 2007/0202468 | A1 | 8/2007 | Iwasawa | |
| 2007/0227056 | A1 * | 10/2007 | Howe | F41G 1/35 42/146 |
| 2007/0258236 | A1 * | 11/2007 | Miller | F21L 4/00 362/205 |
| 2008/0040965 | A1 | 2/2008 | Solinsky et al. | |
| 2009/0139846 | A1 | 6/2009 | Faifer | |
| 2009/0307955 | A1 * | 12/2009 | NuDyke | F41C 27/00 42/117 |
| 2010/0097789 | A1 | 4/2010 | Sharrah et al. | |
| 2010/0164401 | A1 | 7/2010 | Matthews et al. | |
| 2010/0176741 | A1 | 7/2010 | Sharrah et al. | |
| 2011/0146128 | A1 | 6/2011 | Haering | |
| 2012/0167436 | A1 | 7/2012 | Westra | |
| 2014/0157645 | A1 * | 6/2014 | Moore | F41G 1/35 42/114 |

OTHER PUBLICATIONS

Crimson Trace tacticle light model CMR-202 RailMaster manual, Crimson Trace, Nov. 11, 2012, http://www.crimsontrace.com/01-3470.*

* cited by examiner

PISTOL MOUNTED LIGHT AND OPERATION THEREOF

CROSS-REFERENCE TO RELATED APPLICATIONS

This application is a continuation of U.S. application Ser. No. 14/599,474, filed Jan. 17, 2015 which is a continuation-in-part of U.S. application Ser. No. 14/401,401, filed Nov. 14, 2014, which is a 371 Nationalization filing of PCT/US2013/04/1644, filed May 17, 2013, which is related to and claims priority from U.S. Provisional Patent Application No. 61/648,134, filed May 17, 2012, the entire contents of which is incorporated herein by reference.

BACKGROUND OF THE INVENTION

The present invention relates generally to a multi-function flashlight assembly that includes an integrated weapon mounting interface making the flashlight capable of being utilized for a handgun having an accessory rail provided ahead of the trigger guard.

In the prior art, flashlights for use in military applications have typically been constructed utilizing a tubular outer housing. In order to facilitate mounting of the flashlight onto other devices, such as military weapons, a relatively large clamp-type mounting assembly was required. Actuation of a flashlight retained in such a manner on the fire arm required a user to press a button at the rear of the flashlight in an axial manner. Such pressure not only contributes to the displacement of the flashlight within the clamp but also requires a user to move their thumb in an awkward manner to operate the flashlight.

In handguns, smaller flashlight accessories are typically mounted ahead of the trigger guard and the operational switches are toggle levers which move up and down. The difficulty with the arrangement is that when a user is gripping a handgun, the hand is oriented vertically, and the motion required to operate the switch is a sideways finger motion (up and down in relation to the weapon). This motion forces use of the finger in a weak and awkward direction as finger strength is significantly better in a front to back motion (i.e. trigger pull motion), not up and down.

In view of the foregoing, there is a need for an assembly that provides an improved method of compactly and reliably mounting a flashlight onto a handgun, and there is a further need for a multi-functional flashlight that is easier to operate and exhibits a high degree of reliability even in the most rugged environment.

BRIEF SUMMARY OF THE INVENTION

In one exemplary embodiment, the outer body of the flashlight includes a head mounted to a flashlight body at one end and at least one paddle switch extending rearwardly at the other end of the body. Preferably the paddle switch extends at least partially beyond the trigger guard on the firearm when the flashlight is mounted to the accessory rail forward of the trigger guard.

Generally, modern handguns include an interface rail for the mounting of auxiliary devices. Typically, the rail is a mil-spec 1913 dovetail interface having a dovetail cross-sectional profile. The outer housing of the flashlight includes a clamping interface that permits mounting of the flashlight to the rail.

Within the head portion there is a composite heat sink/reflector assembly to collect and dissipate the waste heat generated during operation of the flashlight. Adjacent a rear surface of the heat sink is a circuit board that includes one or more LEDs positioned thereon. In the exemplary embodiment, the LEDs include a visible white LED positioned centrally within the reflector. Optionally there may be an infra-red LED positioned adjacent the white LED and/or at the periphery of the opening in the reflector. Further still, a laser diode may be installed therein in addition to the white and IR LED's or in place of the IR LED.

To provide multiple switches, one or both of the paddle switches may be divided into two switches whereby a first half operates the light and a second half operates the laser. In this manner a user can easily control the function of the light using the paddles. The paddles may operate in an ambidextrous or duplicate fashion such that the left and right paddles each functions the same as its counterpart. This allows comfortable use on a handgun regardless of the shooter's handedness.

In another exemplary embodiment, the flashlight has both white and IR LEDs, a selector switch on the bottom of the housing, and indicator LED's corresponding to the white and IR LEDs to visually indicate the current operational mode of the light.

The flashlight comprises a housing having a first light source (white LED) and a second light source (IR LED) at one end thereof and a switching mechanism disposed at the opposing end thereof. A selector switch for controlling an operational mode of the flashlight is located on the bottom surface of the housing and is operable to select a first operating mode wherein the first light source (white LED) is selected for illumination, and a second operating mode wherein said second light source (IR LED) is selected for illumination.

The flashlight further includes a first color indicator light (white or yellow LED) corresponding to the first light source (white LED) which is operable for visually indicating the first operating mode and a second color indicator light (red LED) corresponding to the second light source (IR LED) which is operable for visually indicating the second operating mode.

A clamping assembly extends from the top of the housing and when mounted on the handgun, the switching mechanism is located adjacent a forward end of the trigger guard.

Consistent with the first exemplary embodiment, the switching mechanism includes a switch and a paddle actuator. The paddle actuator has a pad surface at one end thereof and an actuator arm at an opposing end thereof. The paddle actuator is mounted on a vertically oriented hinge pin whereby the pad surface extends rearwardly adjacent to the side of a forward end of the trigger guard. In the exemplary embodiment, there are two symmetrical paddle switches which operate independently so that the light is functional for both left-handed and right-handed shooters.

In use, the paddle actuator is hingeably movable in a side-to-side motion (trigger pull motion-inwardly toward the trigger guard) between an unactuated position where the actuator arm is spaced from the switch, and an actuated position where the actuator arm engages and activates the switch. The switching mechanism further includes a coil spring captured between the paddle actuator and the housing normally biasing the paddle actuator to the unactuated position.

With this arrangement, the flashlight is operable in the first operating mode when the selector switch indicates the first mode and the paddle actuator is selectively moved to the actuated position, and further the flashlight is operable in a second operating mode when the selector switch indicates the second mode and the paddle actuator is selectively moved to the actuated position.

When the light is OFF, pressing either of the paddle switches will turn the currently selected LED on. To see the currently selected mode when the light is OFF, the user presses once on the selector switch to illuminate or flash the indicator LED of the currently selected mode, i.e. white. Pressing the selector switch again within 2 second will change the mode to IR, and flash or illuminate the other indicator LED to indicate the change in mode to IR. Pressing the selector again after 2 second will now illuminate the currently selected mode (which is now IR). When the light is ON, pressing the selector switch will immediately toggle the current mode to the other mode.

BRIEF DESCRIPTION OF THE DRAWINGS

Exemplary embodiments will now be described further by way of example with reference to the following examples and figures, which are intended to be illustrative only and in no way limiting upon the scope of the disclosure.

DETAILED DESCRIPTION OF THE EXEMPLARY EMBODIMENTS

Figure 1:
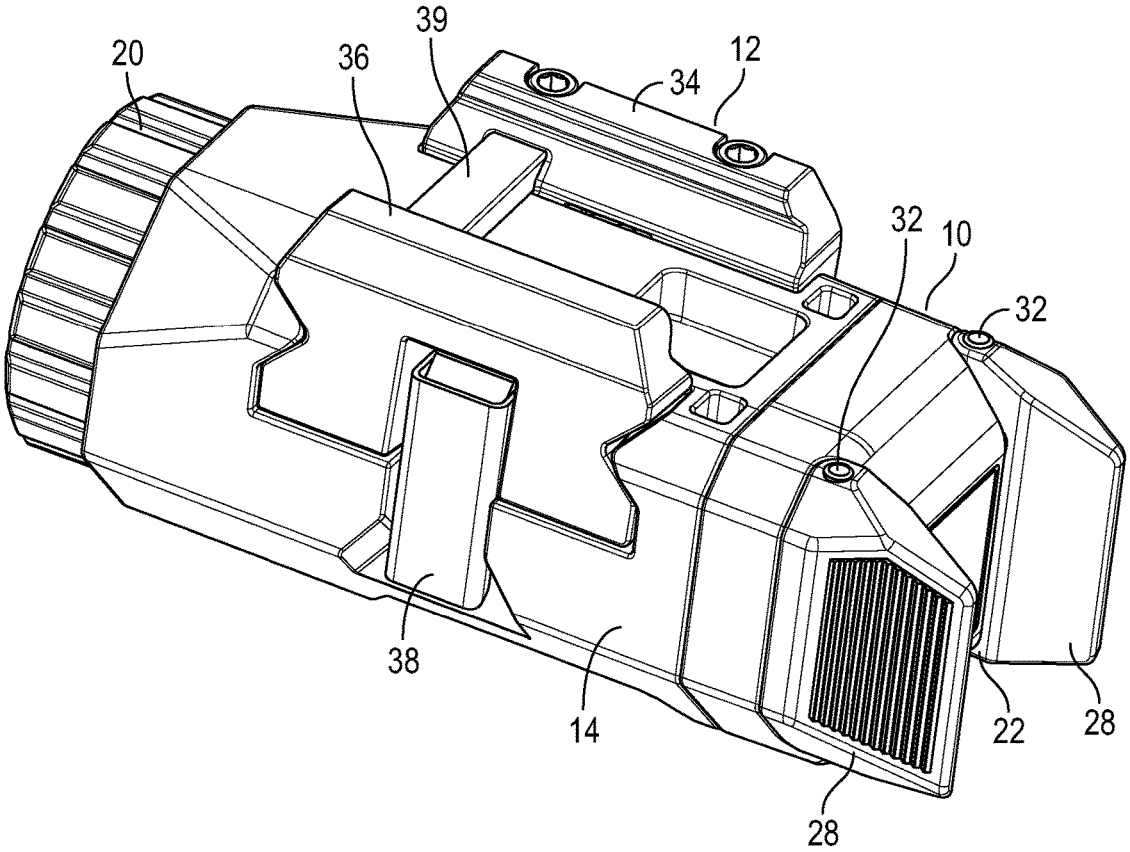
FIG. 1 is a side view of one exemplary flashlight assembly.

Now referring to the drawings, one exemplary embodiment of the present flashlight assembly is shown and generally illustrated in FIGS. 1-8*c*.

Figure 2:
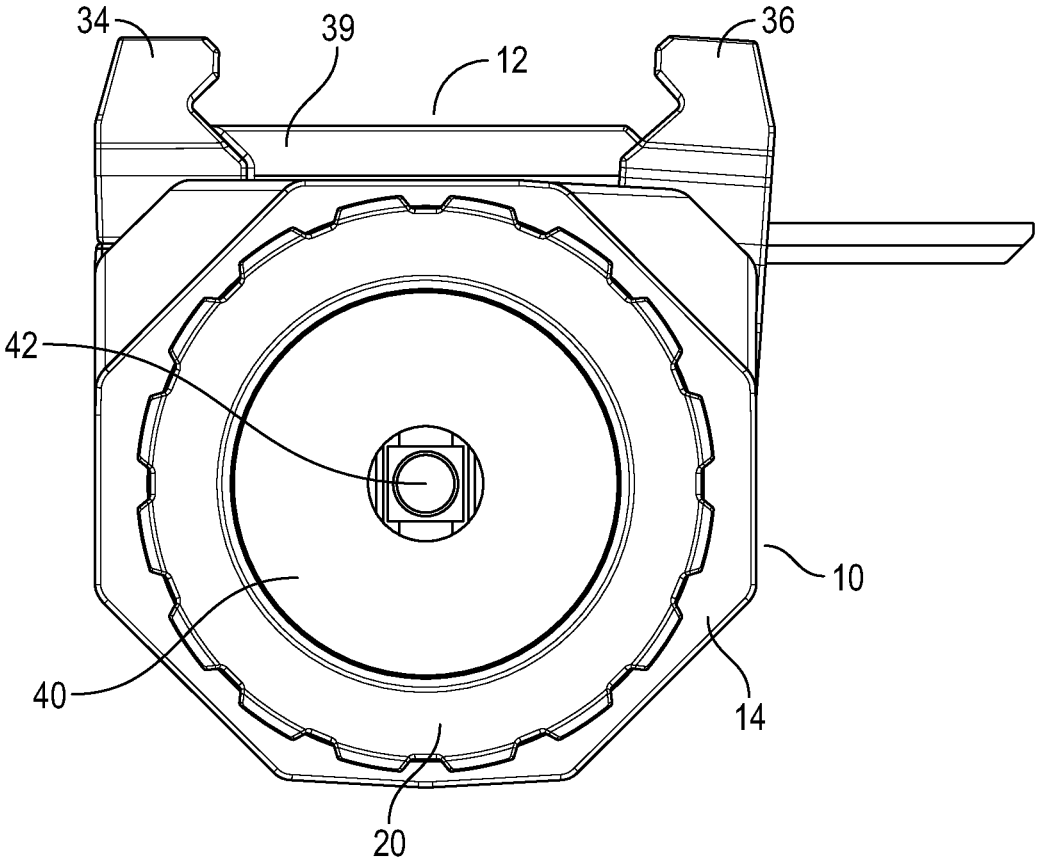
FIG. 2 is a front view thereof.
Figure 3:
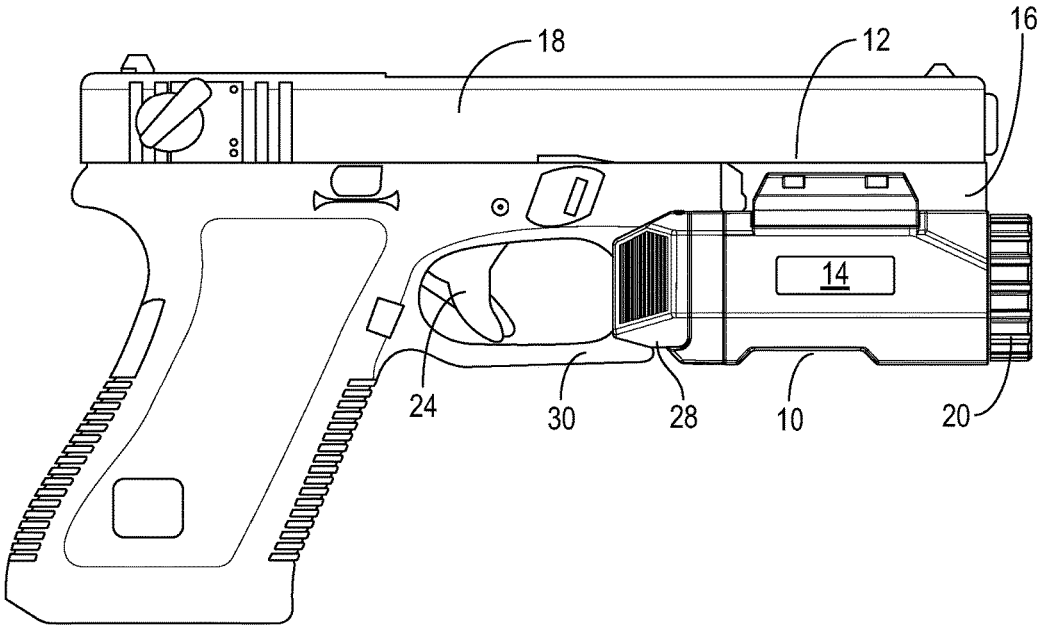
FIG. 3 is a side view thereof while affixed to a handgun.
Figure 4:
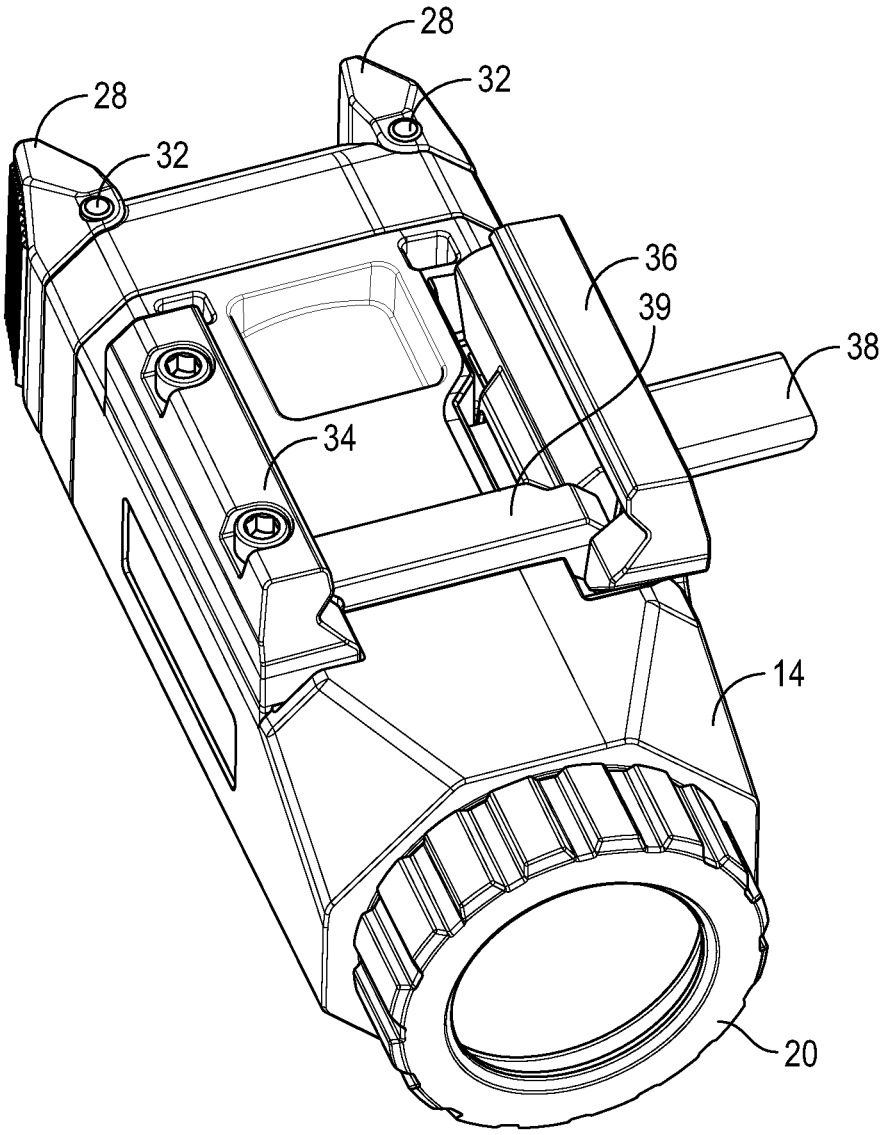
FIG. 4 is a top view of the flashlight showing the clamping assembly.

As can be seen in FIGS. 1-3, the flashlight assembly 10 includes a clamp interface 12 integrated into the housing 14 to facilitate mounting of the flashlight 10 to the dovetail rail 16 on a handgun 18. Generally, the outer body of the flashlight 10 includes a head 20 mounted to a flashlight housing 14 at one end and a switching mechanism 22 extending outwardly at the other end of the housing 14 (see longitudinal housing axis A in FIG. 5*a*). The interface 12 comprises opposing clamping protrusions extending from housing 14.

As depicted at FIG. 3, the handgun 18 generally includes an interface rail 16 for the mounting of auxiliary devices. The rail 16 is known in the art as a mil-spec 1913 rail. The rail 16 generally has a dovetail cross-sectional profile that extends below the barrel of the handgun ahead of the trigger 24. The clamping interface 12 is a seamless and integrated feature of the outer housing 14 of the flashlight itself and allows the flashlight to be securely mounted below the barrel forward of the trigger guard 30. In this manner, the actuator paddles 28 of the light extend rearward adjacent the trigger guard 30 and may protrude slightly beyond the trigger guard 30 to make them convenient to operate.

As shown in the figures, the clamping interface 12 includes a fixed clamping arm 34, a second movable clamping arm 36 and a tightening mechanism 38 for tightening the movable arm 36 around the rail 16. The tightening mechanism 38 for the clamping arm 36 interface may be set screws, thumb screws, quick release type mechanisms or combinations thereof to allow easy mounting and demounting of the flashlight relative to the firearm. A cross bar 39 extends across the bottom of the housing and is received in positioning slots in the rail to prevent sliding of the light when mounted.

The clamping interface 12 may alternatively be formed as a rigid profile that is simply slid onto the firearm accessory rail 16 and retained in place using setscrews.

Figure 5:
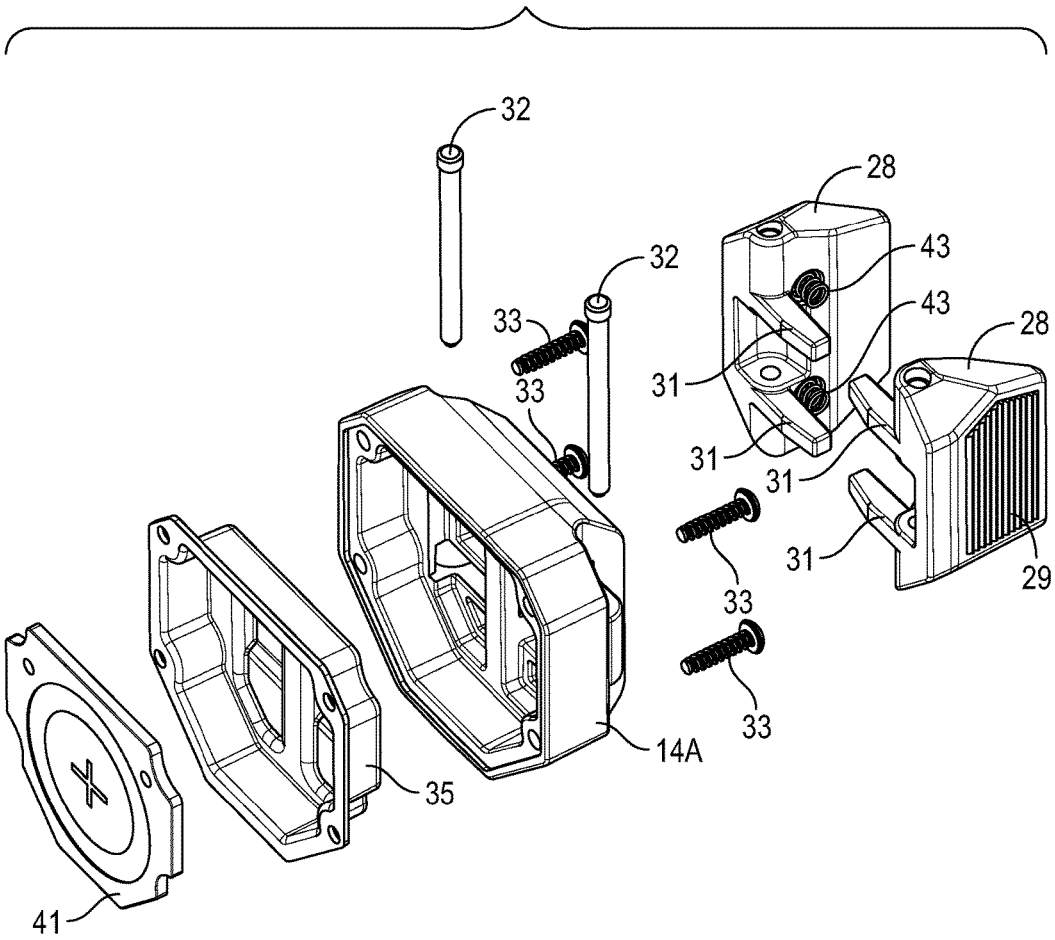
FIG. 5 is an exploded view of the switching assembly.
Figure 5A:
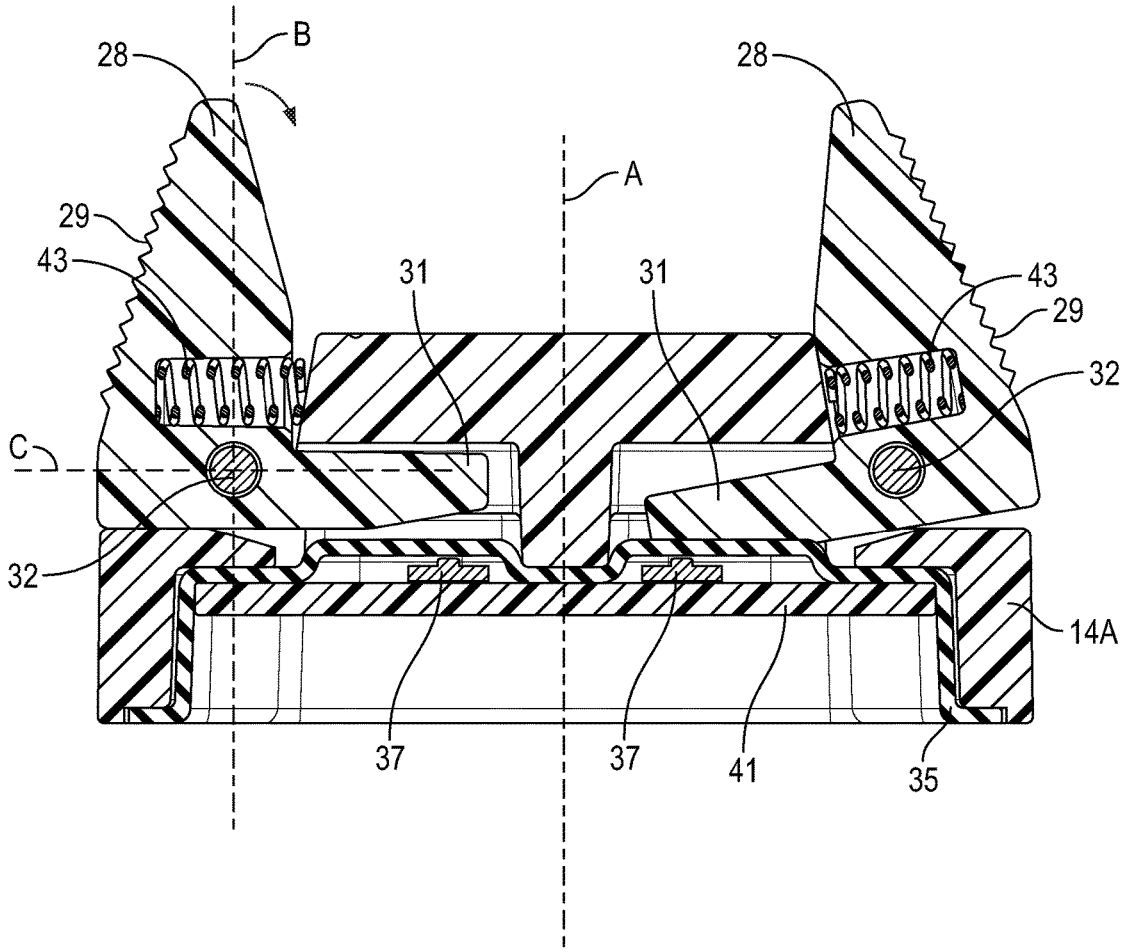
FIG. 5*a* is a cross-sectional view of the switching assembly.
Figure 6:
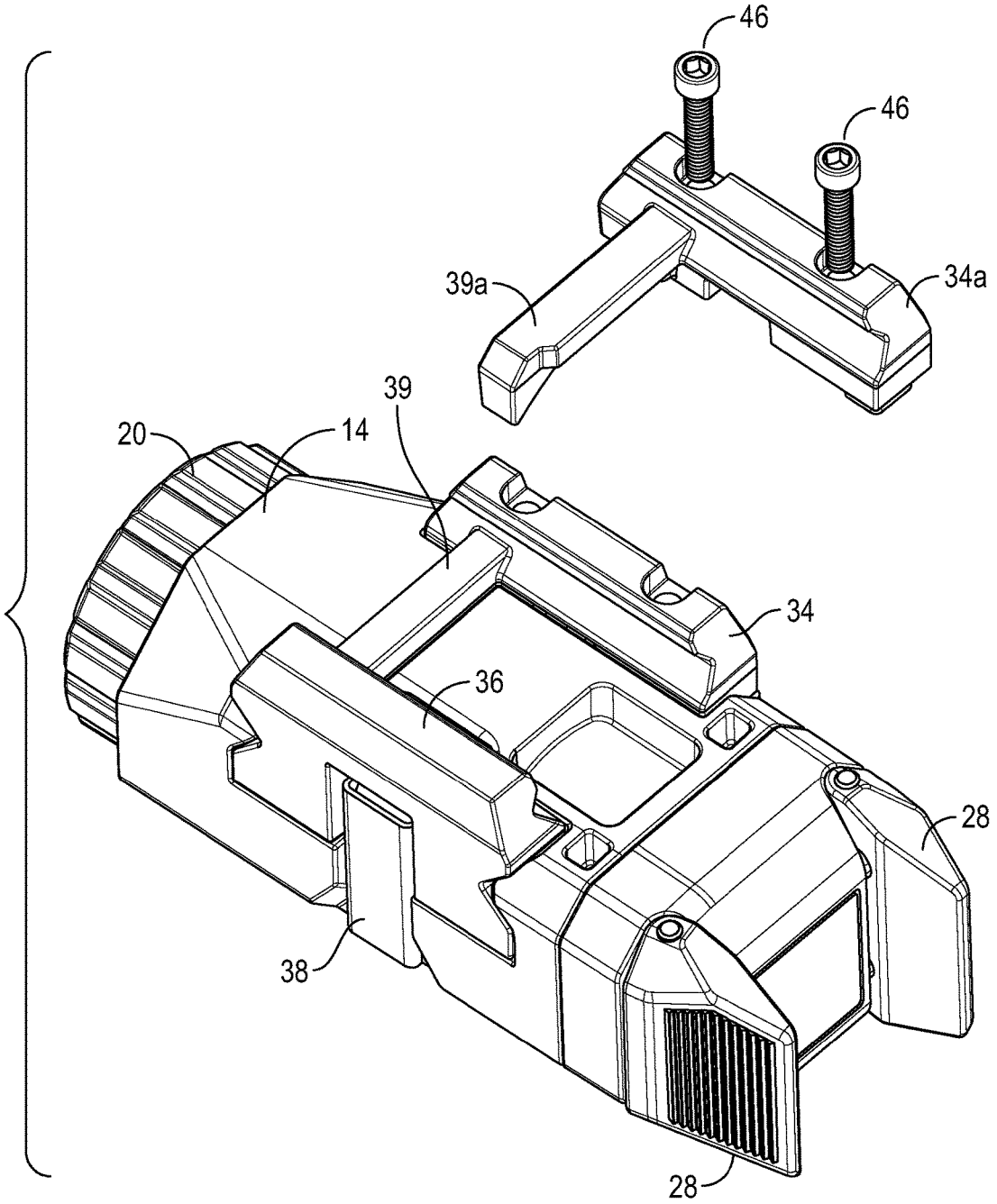
FIG. 6 is a top view thereof.

Turning to FIGS. 5 and 5*a*, the operation of the flashlight 10 of the present invention is highly ergonomic as compared to the flashlights of the prior art. Previously there was a toggle lever that the user had to awkwardly move up or down. This motion required the user to engage the lever laterally with their finger where there is little lateral muscle strength. Instead, the present invention employs a vertically oriented paddle switch 28 that is operated by the user pressing the pad of the user's trigger finger inwardly against a planar pad surface 29 of the paddle 28 (See paddle plane B in FIG. 5*a*). Since this motion is coincident with the user's gripping motion (trigger pull motion) they have a great deal more strength, making operation intuitive and comfortable.

The operation of the paddle switch 28 is about a vertically oriented hinge point 32 that allows the paddles to extend in a vertical orientation, rearwardly adjacent the trigger guard. The paddle 28 includes an actuator arm 31 that extends from the end opposing the pad surface 29 (See arm plane C in FIG. 5*a*) and into a cap 14A at the rear of the flashlight housing 14 to cause the light to operate. The paddle switch 28 is movable about the hinge point 32 between an unactuated position (shown on the left side of FIG. 5*a*) and an actuated position (shown on the right side of FIG. 5*a*). Springs 43 contained within the paddle 28 (See FIG. 5*a*) are captured between the paddle 28 and the housing 14A and normally bias the paddle 28 to the unactuated position (left side of FIG. 5*a*). As seen on the right side of FIG. 5*a*, the paddle actuator arm 31 flexes a water seal cap 35 and presses a switch 37 that is located on a circuit board 41 contained within the cap 35. The cap 14A and water seal cap 35 are held to the main housing 14 with screws 33.

Returning to FIG. 2, within the head portion 20 there is a composite heat sink/reflector assembly 40 to collect and dissipate the waste heat generated during operation of the flashlight. Adjacent a rear surface of the heat sink 40 is positioned a circuit board (not shown) that includes at least one LED positioned thereon. In the exemplary embodiment the LED is a visible white LED 42 positioned centrally within the reflector 40. Optionally, there may be one or more infra-red LEDs (not shown) positioned adjacent the white LED 42 and at the periphery of the opening in the reflector. A selector switch (not shown) may be provided on the light to toggle between visible and infrared modes. The switches and LEDs are controlled by a central processor (not shown) having control software for operation of the LEDs and various control switches.

It is known that different configurations of mounting rails 16 employ positioning slots that vary in width. To accommodate these variations, the fixed side of the clamping assembly 34 is modular and removable. In this manner the fixed side of the clamping assembly 34 can be removed along with the cross bar 39 and replaced with an alternate piece 34*a*/39*a* having a cross bar of a different width. In this manner, the interchangeable clamping assemblies 34/34*a* can be removed and replaced simply by removing and replacing two screws 46 or other appropriate fasteners.

Figure 7:
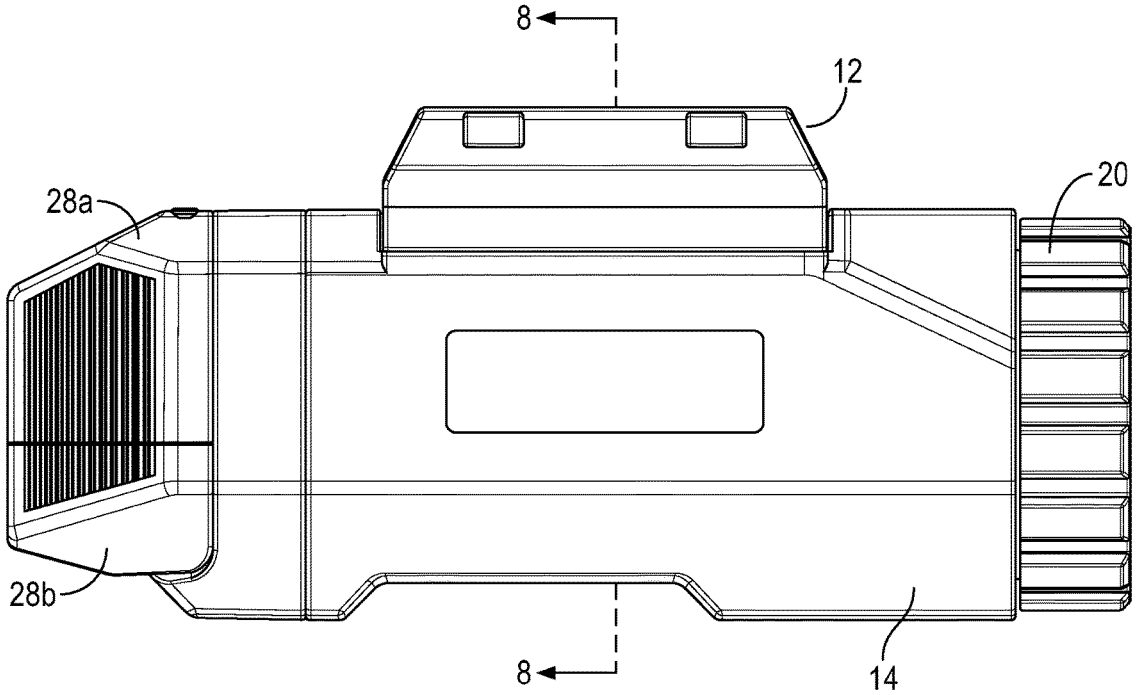
FIG. 7 is a side view of the flashlight showing another exemplary switching configuration.

A further exemplary embodiment is shown at FIG. 7 where, to provide a selector switch, the paddle switch 28 may be broken into two switches such that a first paddle switch 28*a* operates the light and a second paddle switch 28*b* functions as a selector switch. In this manner a user can easily control the function of the light 10 using the paddles 28. It is preferred that the paddles operate in an ambidextrous or duplicate fashion such that the left and right paddles 28 each function the same as its counterpart. This allows comfortable use on a handgun regardless of the shooter's handedness.

Further, the flashlight may include a laser sighting module in either visible red or green, infrared or a combination thereof.

Figure 8A:
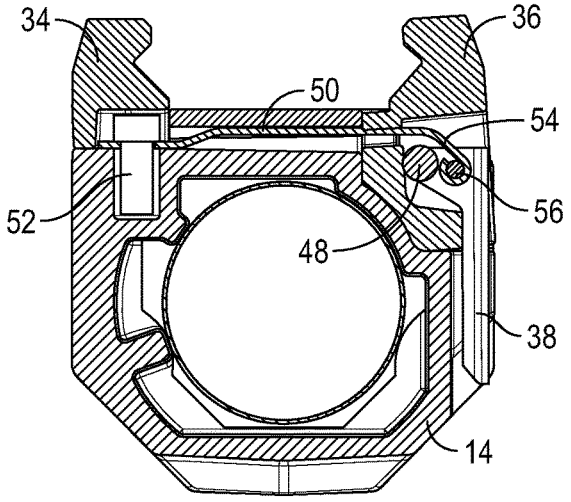
FIGS. 8*a*, 8*b* and 8*c* are cross sectional views taken along the line 8-8 of FIG. 7 depicting the operational positions of the exemplary clamping assembly.
Figure 8B:
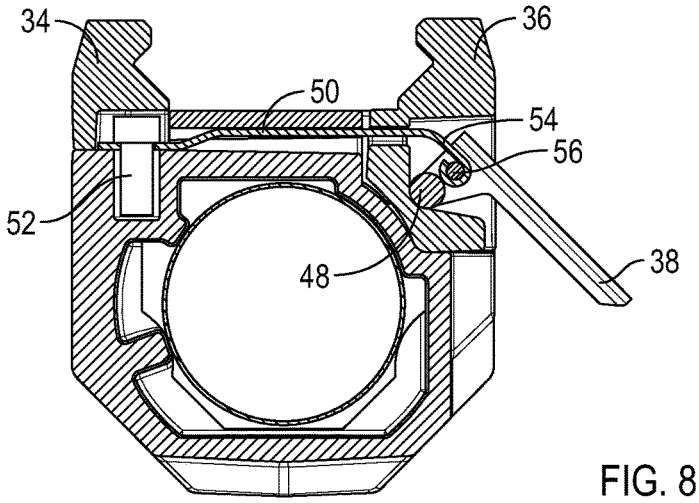
Figure 8C:
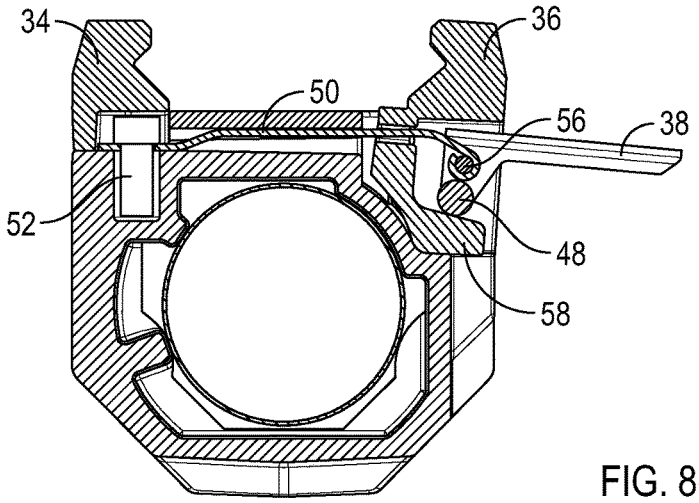
Figure 9:
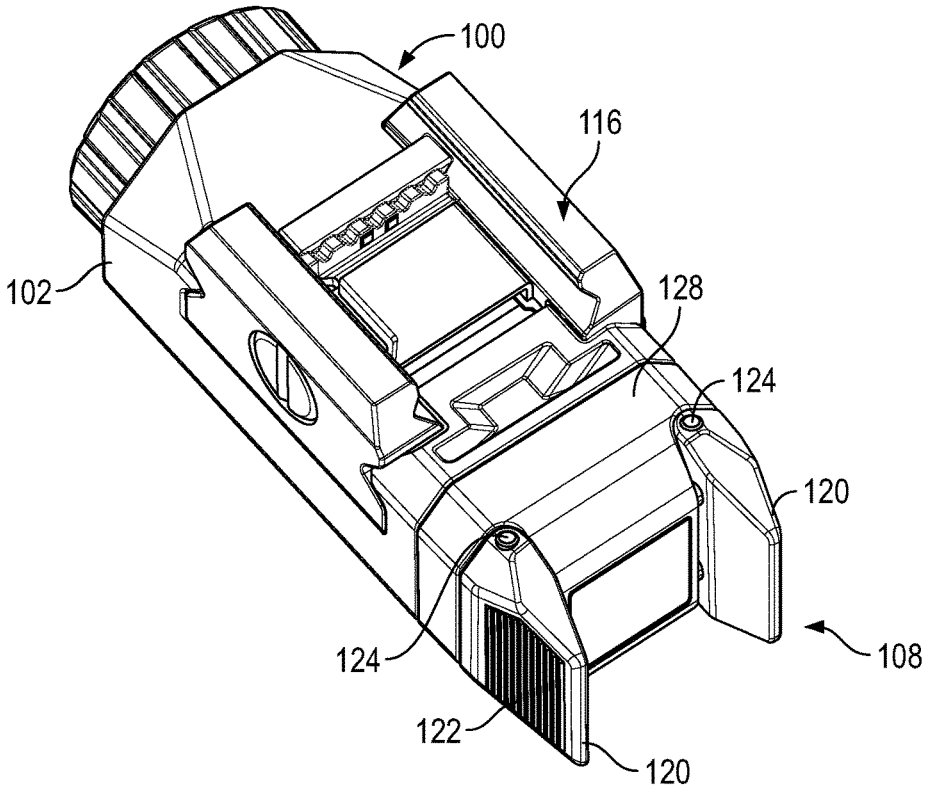
FIG. 9 is a perspective view of another exemplary embodiment of the flashlight including a selector switch and operational mode indicator LEDs.
Figure 10:
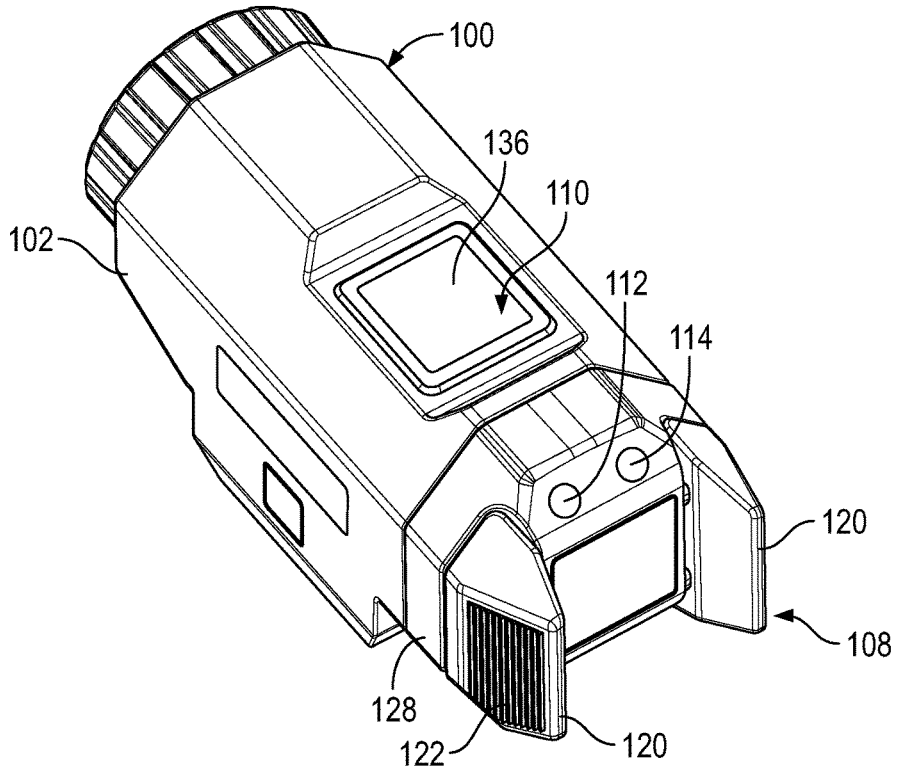
FIG. 10 is another perspective view thereof.

The operation of the clamping mechanism is depicted at FIGS. 8*a*, 8*b* and 8*c*. The clamp at FIG. 8*a* is shown fully engaged. The actuator lever 38 is pressed against the body of the flashlight such that the front roller 48 on the lever presses the movable clamping arm 36 against the firearm accessory rail. The clamping force is generated by the lever arm 38 drawing tension against the spring band 50 that is pinned 52 across the clamping assembly. Further, the offset 54 in the spring band 50, in combination with the elevational offset in the roller pin 48 and retainer pin 56 causes a tactile engaging force as the lever is depressed and the clamp is engaged. These offsets cause the clamp to snap shut and serves to retain the lever arm in a closed position.

As can be seen at FIG. 8*b*, as the lever arm 38 is opened against the spring force, the lever arm 38 comes to a neutral position once the retainer pin 56 is displaced above the roller pin 48 allowing the spring force generated by the two offsets to be released. In this neutral position, while the movable clamping arm is still substantially closed, the clamping force is released.

Finally, at FIG. 8*c*, the lever arm 38 is lifted upwardly such that the roller pin 48 presses down on the lower portion 58 of the movable clamping arm 36 causing it to displace outwardly relative to the flashlight body. This displacement causes the clamping arm to open and allows the flashlight to be installed onto or removed from the firearm accessory rail.

Turning to FIGS. 9-15, another exemplary embodiment of the flashlight is shown and generally indicated at 100. Generally, the flashlight 100 has both white and IR LEDs, a selector switch 106 on the bottom of the housing, and indicator LED's corresponding to the white and IR LEDs to visually indicate the current operational mode of the light.

The flashlight 100 comprises a housing 102 having a first light source (white LED) 104 and a second light source (IR LED) 106 at one end thereof and a switching mechanism 108 disposed at the opposing end thereof. A selector switch 110 for controlling an operational mode of the flashlight 100 is located on the bottom surface of the housing 102 and is operable to select a first operating mode wherein the first light source (white LED) 104 is selected for illumination, and a second operating mode wherein said second light source (IR LED) 106 is selected for illumination.

The flashlight 100 further includes a first color indicator light (white or yellow LED) 112 corresponding to the first light source (white LED) 104 which is operable for visually indicating the first operating mode and a second color indicator light (red LED) 114 corresponding to the second light source (IR LED) 106 which is operable for visually indicating the second operating mode.

A clamping assembly generally indicated at 116 extends from the top of the housing 102 and when mounted on a handgun 18, the switching mechanism 108 is located adjacent a forward end of the trigger guard 30.

Consistent with the other exemplary embodiments, the switching mechanism 108 includes a switch 118 and a paddle actuator 120. The paddle actuator 120 has a pad surface 122 at one end thereof and an actuator arm (see FIG. 5A) at an opposing end thereof. The paddle actuator 120 is mounted on a vertically oriented hinge pin 124 whereby the pad surface 122 extends rearwardly adjacent to the side of a forward end of the trigger guard 30. As in the other exemplary embodiments, the paddle actuator arm flexes a water seal cap and presses switch 118 that is located on a main circuit board 126 contained within a rear cap 128. In the exemplary embodiment, there are two symmetrical paddle switches 118 and paddles 120 which operate independently so that the light 100 is symmetrically functional for both left-handed and right-handed shooters.

In use, the paddle actuator 120 is hingeably movable in a side-to-side motion (trigger pull motion—inwardly toward the trigger guard) between an unactuated position where the actuator arm is spaced from the switch 118, and an actuated position where the actuator arm engages and activates the switch 118. The switching mechanism 108 further includes a coil spring (See FIG. 5A) captured between the paddle actuator 120 and the housing 102 normally biasing the paddle actuator 120 to the unactuated position.

Figure 11:
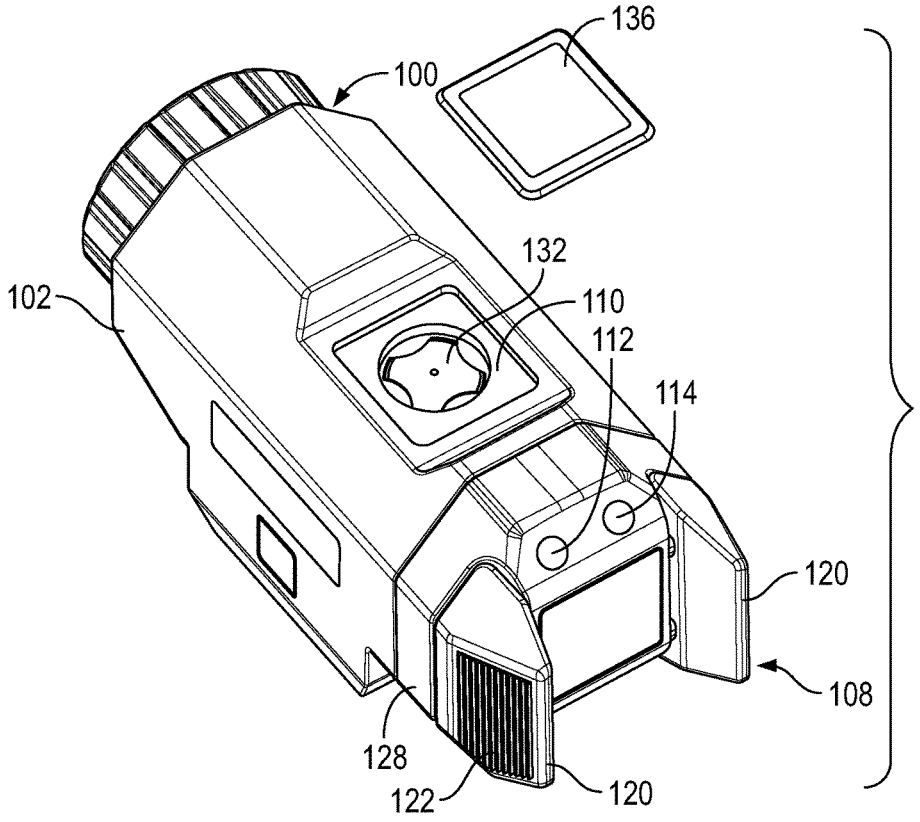
FIG. 11 is still another perspective view thereof with the elastomeric cover exploded from the selector switch.
Figure 12:
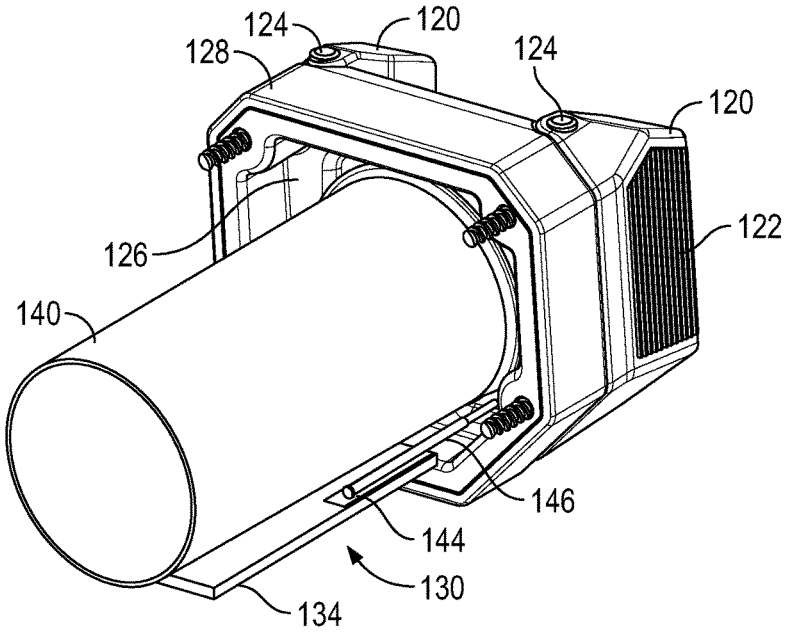
FIG. 12 is a perspective view of the switching subassembly.
Figure 13:
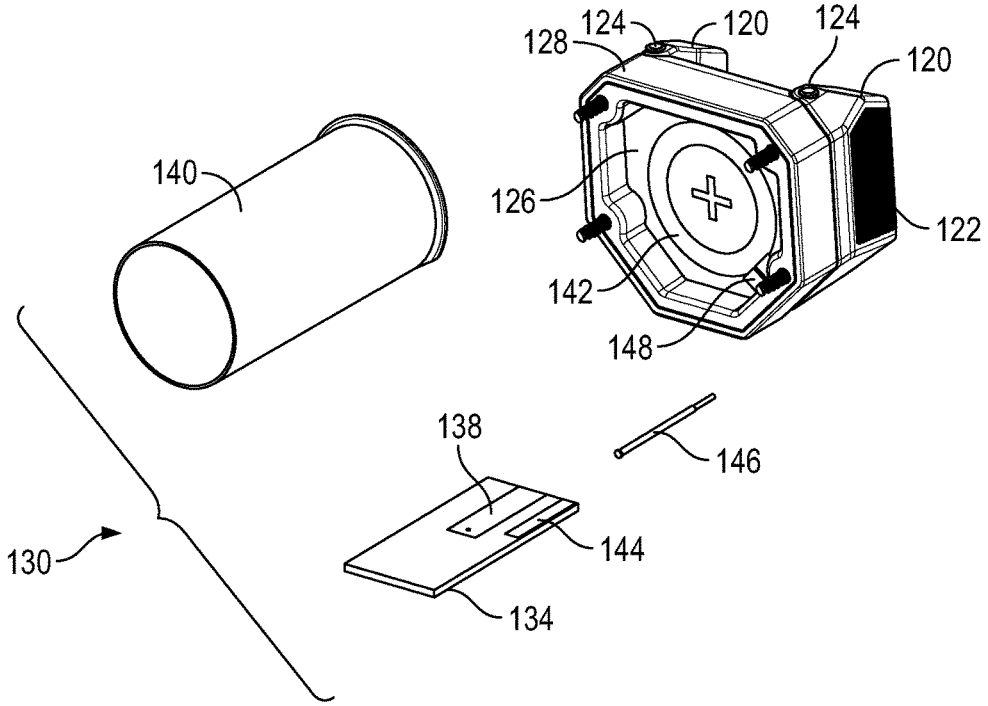
FIG. 13 is an exploded perspective view thereof.
Figure 14:
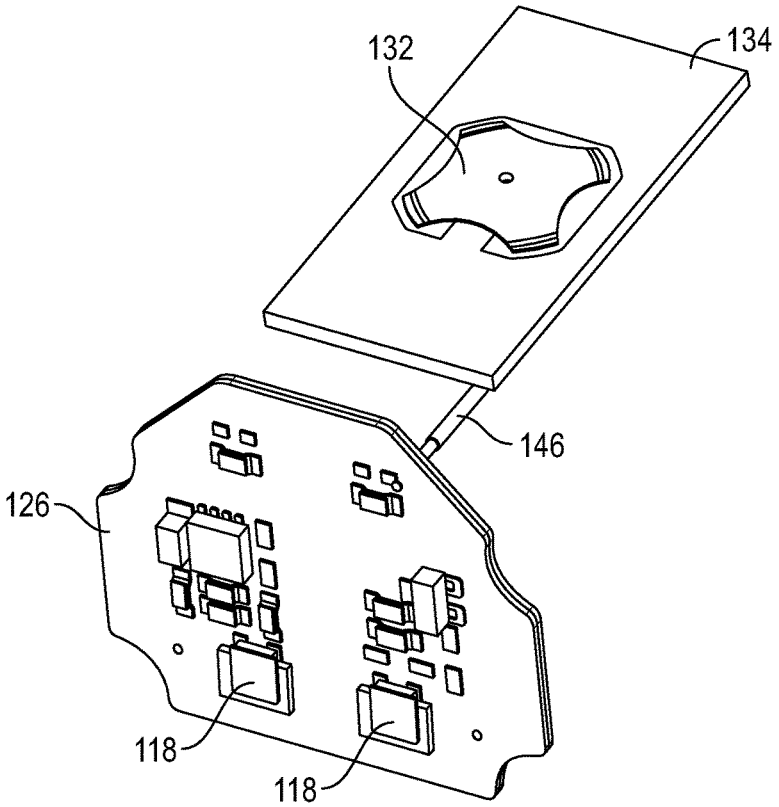
FIG. 14 is a bottom perspective view of the rear circuit board, the selector switch circuit board and pogo pin.
Figure 15:
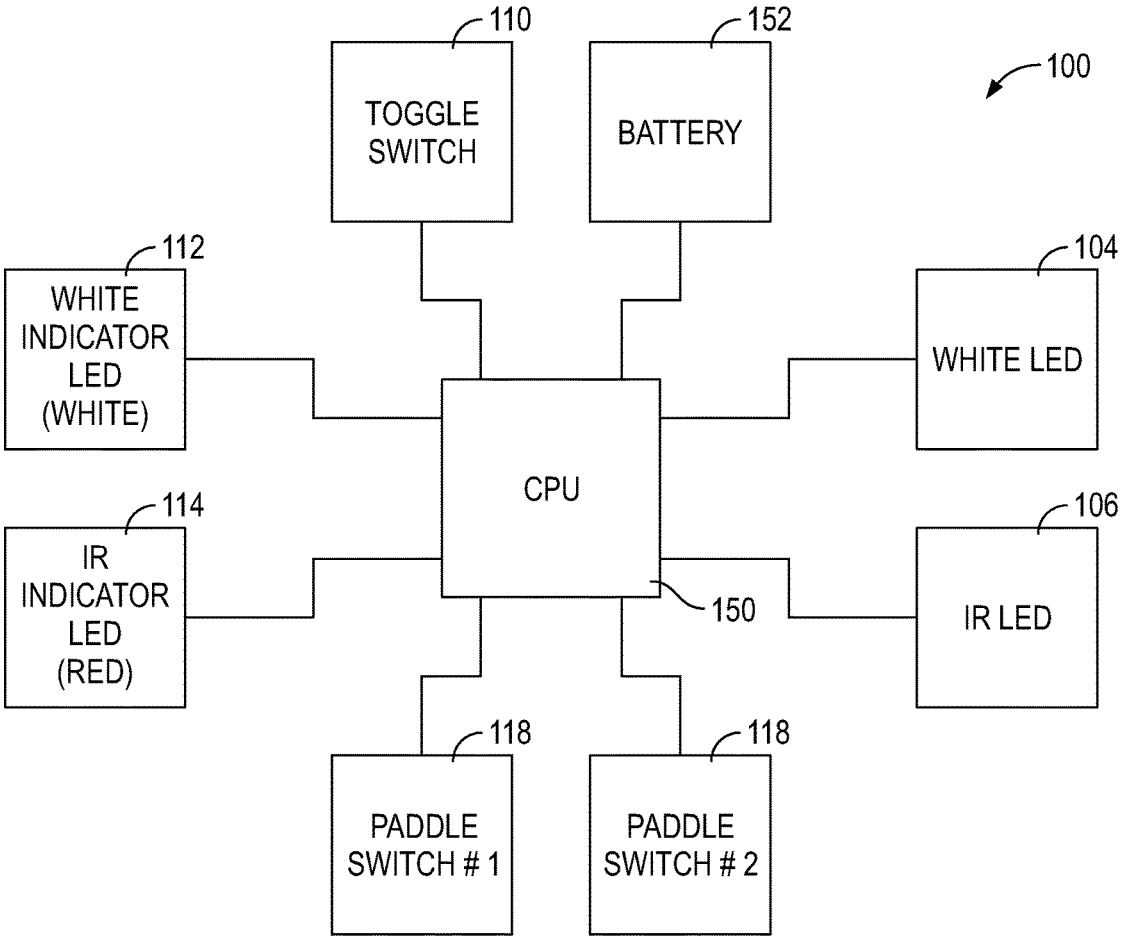
FIG. 15 is a block diagram of the individual components.

Turning to FIG. 11-14, there is shown the selector switch assembly 110, which generally comprises a dome switch 132 mounted on a secondary circuit board 132 extending longitudinally along the bottom of the housing 102. As seen in FIG. 11, the dome switch 132 is accessible through an opening in the bottom of the housing 102 and resides beneath a rubberized cover 136. To connect the switch contacts of the dome switch 132 to the main circuit board 126 a first contact pad 138 on the inner surface of the circuit board 134 engages a metallic battery tube 140, which in turn engages a contact pad 142 on the rear surface of the main circuit board 126. A second contact pad 144 is engaged by a biased pogo pin 146 extending from another contact pad 148 on the rear surface of the main circuit board 126. When assembled, pressure on the dome switch 132 closes the circuit providing a control signal to the main circuit board 126.

The switches 118, LEDs 104,106 and indicator LEDs 112,114 are controlled by a central processor 150 having control software for operation of the LEDs and various control switches, and the system is powered by a battery 152 received in the battery tube.

With this arrangement, the flashlight 100 is operable in the first operating mode when the selector switch 110 indicates the first mode and the paddle actuator 120 is selectively moved to the actuated position, and further the flashlight 100 is operable in a second operating mode when the selector switch 110 indicates the second mode and the paddle actuator 120 is selectively moved to the actuated position.

When the light is OFF, pressing either of the paddle switches 120 will turn the currently selected LED on (104 or 106). To see the currently selected mode when the light is OFF, the user presses once on the selector switch 110 to illuminate or flash the indicator LED (112 or 114) of the currently selected mode, i.e. white. Pressing the selector switch 110 again within 2 second will change the mode to IR, and flash or illuminate the other indicator LED to indicate the change in mode to IR. Pressing the selector switch 110 again after 2 second will now illuminate the currently selected mode (which is now IR). When the light is ON, pressing the selector switch 110 will immediately toggle the current mode to the other mode.

It can be seen that the exemplary embodiments provide a multi-functional flashlight construction that is easier to operate and that exhibits a high degree of reliability even in the most rugged environment. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A flashlight comprising:

a housing having a light source disposed at a first forward end thereof and further having a switching mechanism disposed at a second rearward end thereof, said housing having a longitudinal axis extending between said first and second ends thereof;

said switching mechanism including a rearward facing switch having an actuation axis extending in a direction parallel to said longitudinal axis of said housing and said switching mechanism further having an L-shaped paddle actuator, said paddle actuator having a paddle portion with an outwardly facing pad surface at one end thereof, said paddle actuator further having an actuator arm portion at an opposing end thereof, said paddle actuator being mounted on a hinge pin which has an axis extending in a direction perpendicular to said longitudinal axis of said housing, whereby said paddle portion extends rearwardly from said hinge pin in a plane which runs parallel to said longitudinal axis of said housing, said actuator arm portion projecting inwardly from said paddle portion adjacent to said hinge pin, said actuator arm portion projecting inwardly in a plane which extends in a direction perpendicular to said longitudinal axis of said housing, said actuator arm portion having a terminal end portion adjacent to said rearward facing switch, said paddle actuator being hingeably movable about said hinge pin whereby said paddle portion pivots inwardly and said terminal end portion of said actuator arm portion pivots forwardly to engage and actuate said rearward facing switch in a direction parallel to said longitudinal axis of said housing, said rearward facing switch being actuable for operation of said light source among a plurality of operating conditions including at least an on condition and an off condition.

2. The flashlight of claim 1, wherein said pad surface is planar.

3. The flashlight of claim 1 further comprising opposing switching mechanisms with opposing paddle actuators, wherein said paddle portions of said paddle actuators extend rearwardly from opposing sides of said housing.

4. The flashlight of claim 3, wherein said pad surfaces are planar.

5. The flashlight of claim 1, further comprising a selector switch for controlling an operational mode of said flashlight.

6. The flashlight of claim 1, wherein said light source is selected from the group consisting of: a white light source, a visible light source, an infra-red light source, and a laser light source.

7. The flashlight of claim 1 further comprising a clamping mechanism.

8. A flashlight comprising:

a housing having a light source disposed at a first forward end thereof and further having a switching mechanism disposed at a second rearward end thereof, said housing having a longitudinal axis extending between said first and second ends thereof;

said switching mechanism including a rearward facing switch and an L-shaped paddle actuator, said paddle actuator having a paddle portion with an outwardly facing pad surface at one end thereof, said paddle actuator further having an actuator arm portion at an opposing end thereof, said paddle actuator being mounted on a hinge pin which has an axis extending perpendicular to said longitudinal axis of said housing, whereby said paddle portion extends rearwardly from said hinge pin in a plane which runs parallel to said longitudinal axis of said housing, said actuator arm portion projecting inwardly from said paddle portion adjacent to said hinge pin, said actuator arm portion projecting inwardly in a plane which extends perpendicular to said longitudinal axis of said housing, said actuator arm portion having a terminal end portion adjacent to said switch, said paddle actuator being hingeably movable about said hinge pin whereby said paddle portion pivots inwardly and said terminal end portion of said actuator arm portion pivots forwardly to engage said rearward facing switch, wherein said switching mechanism further comprises a circuit board extending perpendicular to said longitudinal axis, said switch being located on a rearward facing surface of said circuit board.

9. The flashlight of claim 8 further comprising a flexible water seal cap extending between said switch and said actuator arm portion.

* * * * *